US010995545B2

(12) United States Patent
Chen

(10) Patent No.: US 10,995,545 B2
(45) Date of Patent: May 4, 2021

(54) MULTISTATE RESISTANCE ADJUSTING DEVICE FOR NON-PULL CORD WINDOW BLIND

(71) Applicant: Po-Yu Chen, Taichung (TW)

(72) Inventor: Po-Yu Chen, Taichung (TW)

( * ) Notice: Subject to any disclaimer, the term of this patent is extended or adjusted under 35 U.S.C. 154(b) by 256 days.

(21) Appl. No.: 16/297,945

(22) Filed: Mar. 11, 2019

(65) Prior Publication Data

US 2019/0323291 A1 Oct. 24, 2019

(30) Foreign Application Priority Data

Apr. 24, 2018 (TW) ..... 107113880

(51) Int. Cl.
*E06B 9/36* (2006.01)
*E06B 9/264* (2006.01)

(52) U.S. Cl.
CPC ..... *E06B 9/361* (2013.01); *E06B 9/264* (2013.01); *E06B 9/364* (2013.01); *E06B 9/368* (2013.01)

(58) Field of Classification Search
CPC ..... E06B 9/361; E06B 9/364; E06B 9/368; E06B 9/264; E06B 9/322; E06B 2009/3222; E06B 9/60
See application file for complete search history.

(56) References Cited

U.S. PATENT DOCUMENTS 1,726,589 A * 9/1929 Schultes ..... E06B 9/60 160/315
7,147,030 B2 * 12/2006 Dalle Nogare ..... E06B 9/56 160/315
8,087,445 B2 * 1/2012 DeWard ..... E06B 9/322 160/170
9,372,497 B2 * 6/2016 Wall ..... G05G 5/06
10,704,323 B2 * 7/2020 Chen ..... E06B 9/322
10,774,582 B2 * 9/2020 Chen ..... F16H 19/0672
2003/0192653 A1 * 10/2003 Nien ..... E06B 9/322 160/168.1 R
2014/0096920 A1 * 4/2014 MacDonald ..... E06B 9/42 160/291
2017/0298688 A1 * 10/2017 Chen ..... F03G 1/00
2018/0119490 A1 * 5/2018 Chen ..... E06B 9/42
2019/0316412 A1 * 10/2019 Lei ..... E06B 9/326
2019/0323288 A1 * 10/2019 Chen ..... E06B 9/322

* cited by examiner

*Primary Examiner* — Johnnie A. Shablack
*Assistant Examiner* — Abe Massad
(74) *Attorney, Agent, or Firm* — Rosenberg, Klein & Lee

(57) ABSTRACT

A multistate resistance adjusting device for a non-pull cord window blind includes a base, an adjusting unit, and an elastic member. The base has a bottom trough provided on the periphery thereof with positioning grooves. The adjusting unit has a control pin provided with a transmission portion rotatable and vertically movable on the base and a positioning portion provided on the outer peripheral surface of the transmission portion and connected with an adjusting rod. When the positioning portion is engaged with one of the positioning grooves, the control pin is disabled from rotating relative to the base and adjusting the resistance applied on the lift transmission cord. When the control pin is moved upwardly to separate the positioning portion thereof from the positioning groove, the control pin is rotatable relative to the base, and the resistance applied on the lift transmission cord is adjustable through the adjusting rod.

4 Claims, 7 Drawing Sheets

MULTISTATE RESISTANCE ADJUSTING DEVICE FOR NON-PULL CORD WINDOW BLIND

BACKGROUND OF THE INVENTION

1. Field of the Invention

The present invention relates to non-pull cord window blinds and more particularly, to a multistate resistance adjusting device for the non-pull cord window blind.

2. Description of the Related Art

As to the general non-pull cord window blind, when the bottom beam is pulled downwardly, the lift transmission cord attached to the slats is pulled out by the bottom beam so as to escape from the cord rolling device gradually, until the slats are completely unfolded. In opposite, when the bottom beam is pushed upwardly, the upward pushing force applied to the bottom beam counteracts the weight of the bottom beam and all the slats, enabling the cord rolling deice to roll up the lift transmission cord successfully, so that the slats can be folded up stably. However, no matter the bottom beam is in the process of being pulled downwardly or pushed upwardly by an external force, once the external force is relieved, the slats will not be easily fallen down or folded up, but able to be stopped at any height at any time because of the appropriate resistance provided by a resistance device of the cord rolling device to the lift transmission cord.

For adapting to different usage requirements, the resistance provided by the resistance device to the lift transmission cord sometimes needs to be adjusted. However, in the aforesaid prior art, the user has to disassemble the whole cord rolling device before adjusts the resistance device and assemble the cord rolling device after the adjustment, that is very inconvenient in operation. Besides, many times of disassembly and assembly may affect the assembly accuracy of the inner members of the cord rolling device.

SUMMARY OF THE INVENTION

It is a primary objective of the present invention to provide a multistate resistance adjusting device for the non-pull cord window blind, which can perform the adjustment without structural disassembly and assembly, thereby increased in usage convenience and ensured with good assembly accuracy.

To attain the above objective, the multistate resistance adjusting device of the present invention includes a base, an adjusting unit, and an elastic member. The base has a bottom plate and a top plate located on the bottom plate and connected with the bottom plate. The top plate has a top hole penetrating through top and bottom surfaces of the top plate. The bottom plate is provided on a top surface thereof with a bottom trough and a fixed shaft located correspondingly to the top hole of the top plate. The top end of the fixed shaft is located out of the bottom trough. The bottom end of the fixed shaft is located in the bottom trough. Besides, the bottom plate has a plurality of positioning grooves provided on the peripheral wall of the bottom trough and arranged at intervals in an arched manner about the fixed shaft. The adjusting unit has a control pin and an adjusting rod. The control pin has an operating portion, a transmission portion, and a positioning portion. The operating portion is inserted through the top hole to protrude from the top plate of the base. The transmission portion is connected with the bottom end of the operating portion and sleeved onto the fixed shaft of the bottom plate of the base in a way that the control pin is rotatable and vertically displaceable. The positioning portion protrudes from the outer peripheral surface of the transmission portion. The axis of the adjusting rod is parallel to the axis of the fixed shaft of the base, and the adjusting rod is adapted for being abutted against a lift transmission cord. The adjusting rod is disposed on the positioning portion of the control pin, thereby movable synchronously with the control pin.

As a result, when the control pin is located at a positioning position, the positioning portion of the control pin is located in the bottom trough of the base and engaged with one of the positioning grooves of the base, so that the control pin is disabled from rotating relative to the base and adjusting the resistance applied on the lift transmission cord at this time. When the control pin is moved upwardly to be located at an adjusting position, the positioning portion of the control pin is located above the bottom trough of the base and separated from the positioning groove which the positioning portion is engaged with previously, so that the control pin is rotatable relative to the base; at this time, the adjusting rod can be used to change the cord arrangement of the lift transmission cord so as to attain the effect of resistance adjustment.

It can be understood from the above description that the multistate resistance adjusting device of the present invention can adjust the resistance applied on the lift transmission cord as long as the control pin is moved upwardly to the adjusting position. The whole process needs no structural disassembly and assembly, so that the effects of increasing usage convenience and maintaining good assembly accuracy are attained.

DETAILED DESCRIPTION OF THE INVENTION

Figure 1:
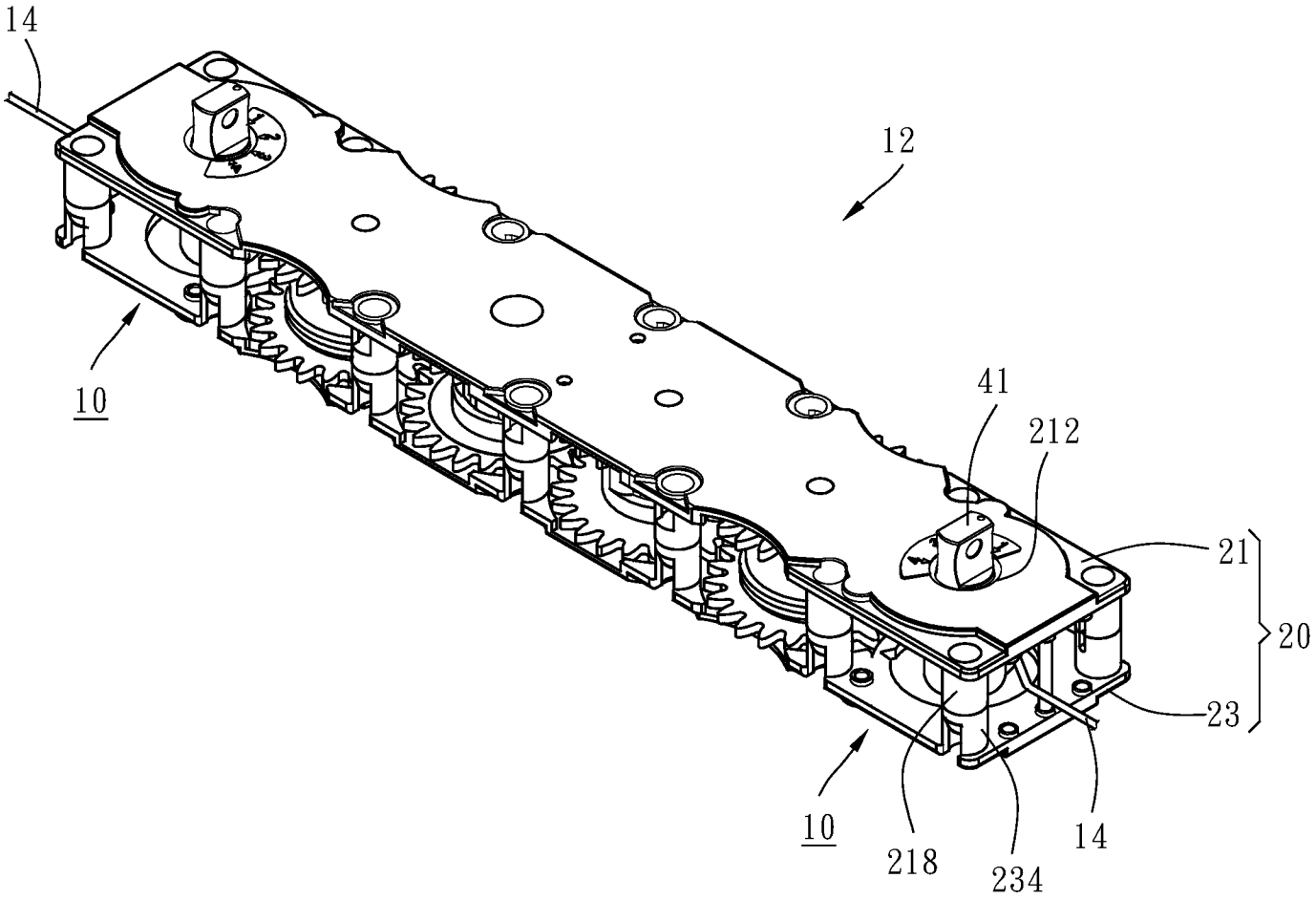
FIG. 1 is a perspective view of the appearance of a cord rolling device using multistate resistance adjusting devices of the present invention.

Referring to FIG. 1, a conventional cord rolling device 12 is shown in FIG. 1, which is not the emphasis of the present invention, so the detailed structure and operating theorem thereof will not be mentioned hereunder. There are two multistate resistance adjusting devices 10 of the present invention disposed in the cord rolling device 12, for corresponding to the amount of the lift transmission cords 14.

Figure 2:
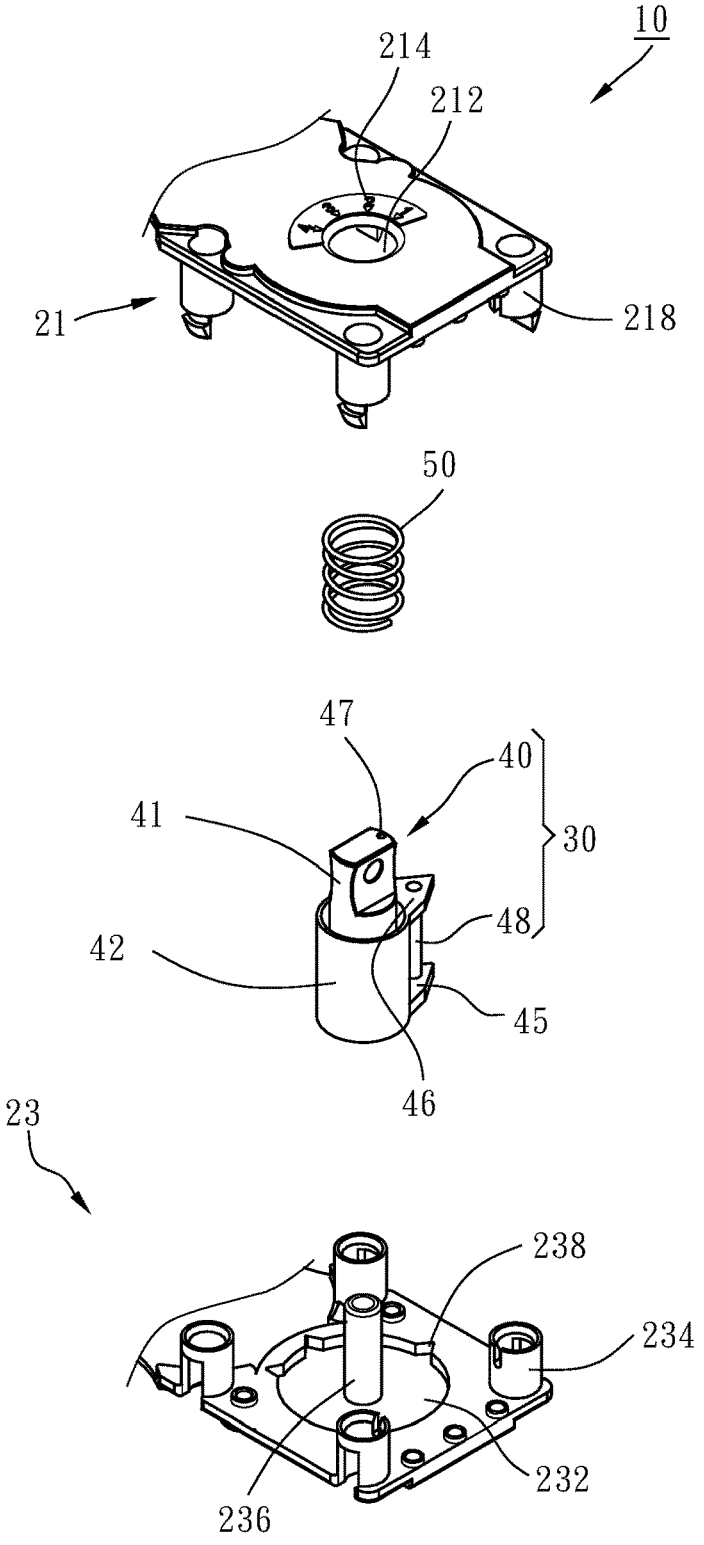
FIG. 2 is an exploded perspective view of the multistate resistance adjusting device of the present invention.

Referring to FIG. 2, the multistate resistance adjusting device 10 of the present invention includes a base 20, an adjusting unit 30, and an elastic member 50.

Figure 3:
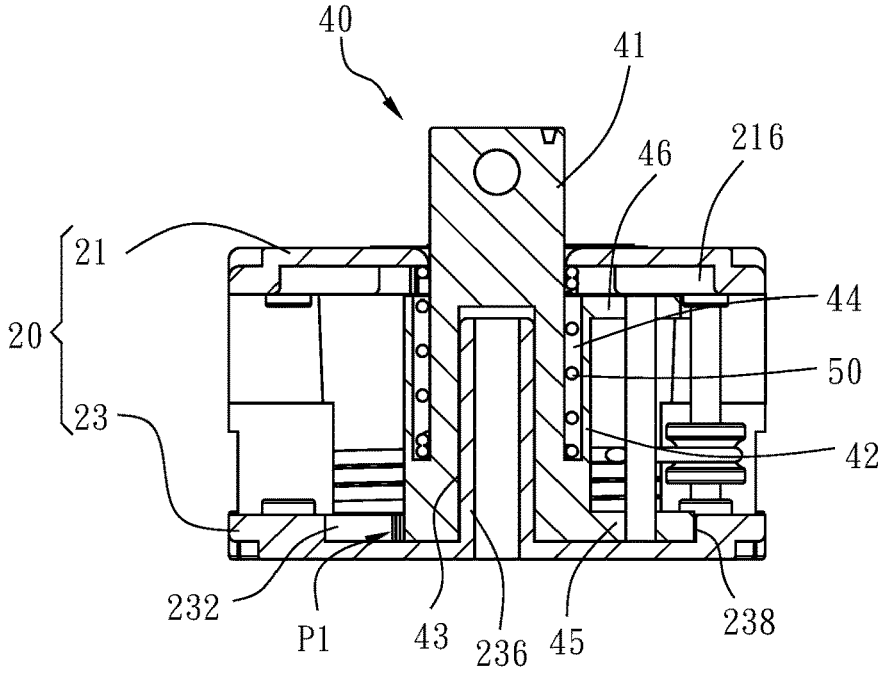
FIG. 3 is a vertical sectional view of the multistate resistance adjusting device of the present invention, primarily showing a control pin is located at a positioning position.
Figure 6A:
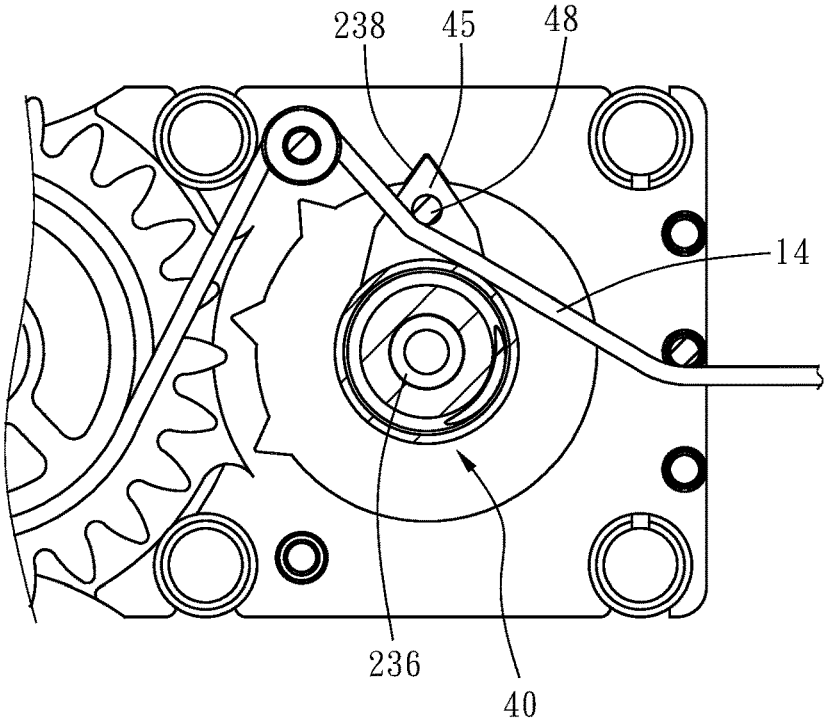
FIGS. 6*a*-6*d* are transverse sectional views of the multistate resistance adjusting device of the present invention, primarily showing a positioning portion of the control pin is engaged with one of positioning grooves of a bottom plate of the base.
Figure 6B:
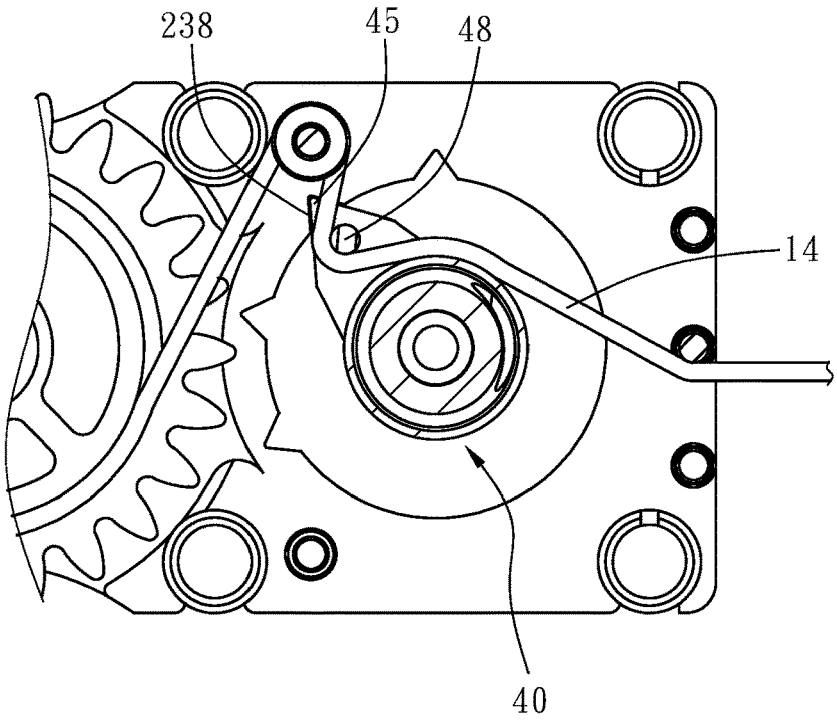
Figure 6C:
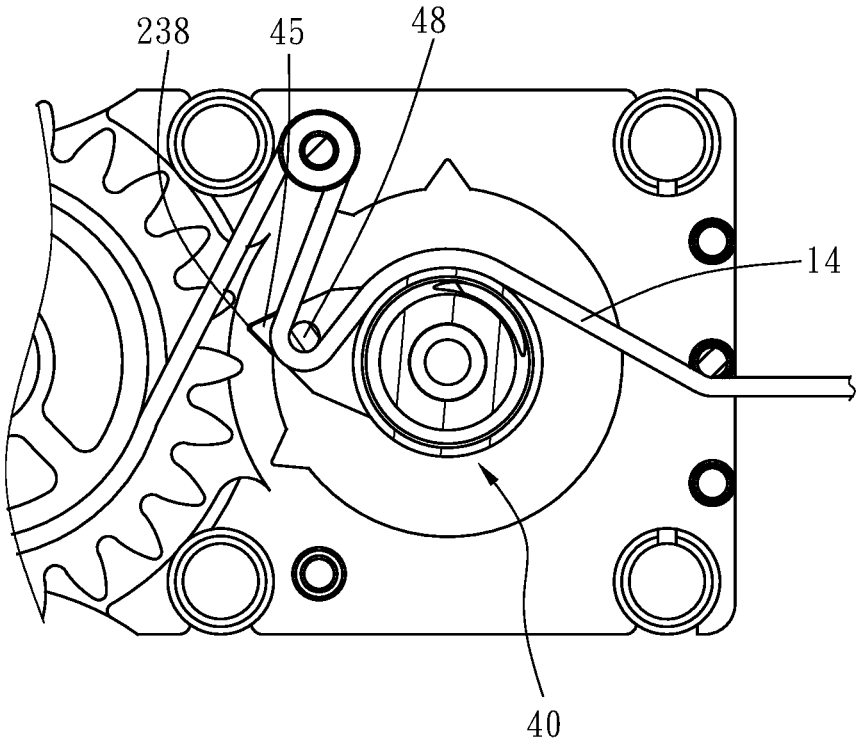
Figure 6D:
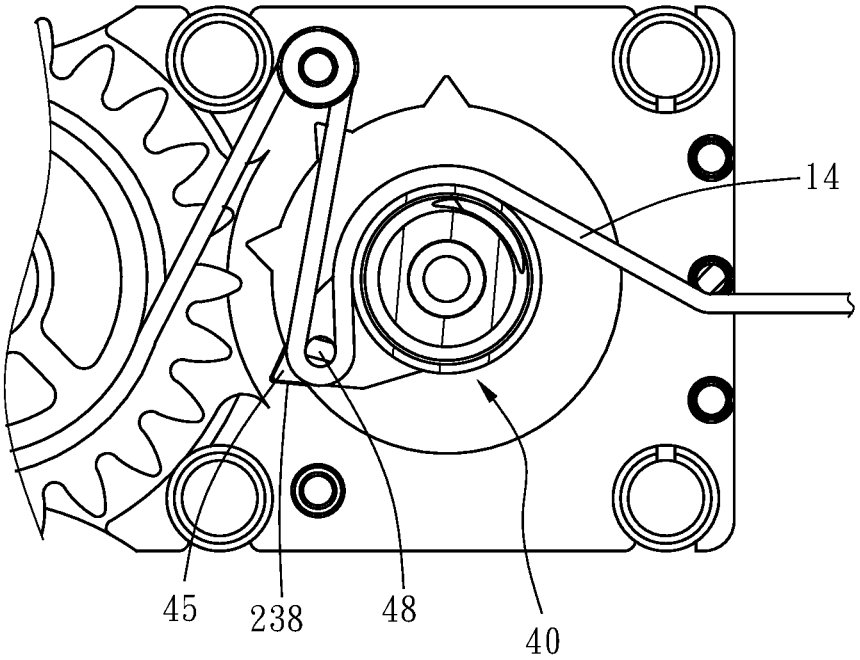

The base 20 has a top plate 21 and a bottom plate 23. As shown in FIG. 2, the top plate 21 is provided at the center thereof with a top hole 212 penetrating through top and bottom surfaces of the top plate 21. The top surface of the top plate 21 is provided around the top hole 212 with four state marks 214 presented by Arabic numerals. The top plate 21 is provided on the bottom surface thereof with a top trough 216 communicating with the top hole 212 as shown in FIG. 3, and four upper peripheral posts 218 located around the top trough 216. The bottom plate 23 is provided on the top surface thereof with a bottom trough 232, and four lower peripheral posts 234 located around the bottom trough 232. The top plate 21 and the bottom plate 23 are combined together through the connection between the upper and lower peripheral posts 218 and 234 opposite to each other, as shown in FIG. 1. The bottom plate 23 is provided at the center thereof with a fixed shaft 236 which is circular-shaped in cross-section thereof and located correspondingly to the top hole 212 of the top plate 21. The top end of the fixed shaft 236 is located out of the bottom trough. The bottom end of the fixed shaft 236 is located in the bottom trough 232. Besides, as shown in FIGS. 2 and 6*a*, the bottom plate 23 has four positioning grooves 238 provided on the peripheral wall of the bottom trough 232 and arranged at intervals in an arched manner about the fixed shaft 236.

Figure 4:
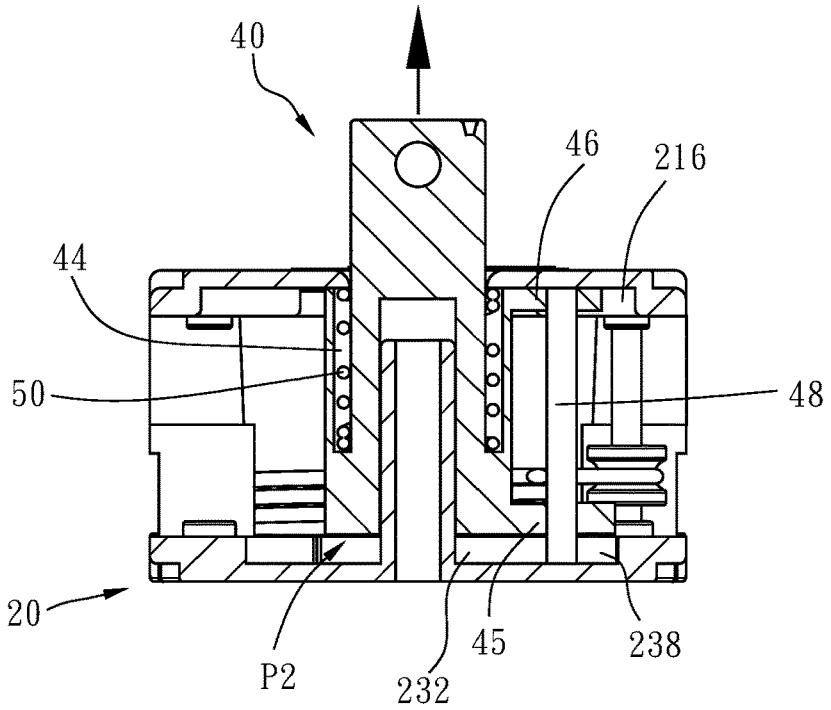
FIG. 4 is similar to FIG. 3, but primarily showing the control pin is located at an adjusting position.
Figure 5A:
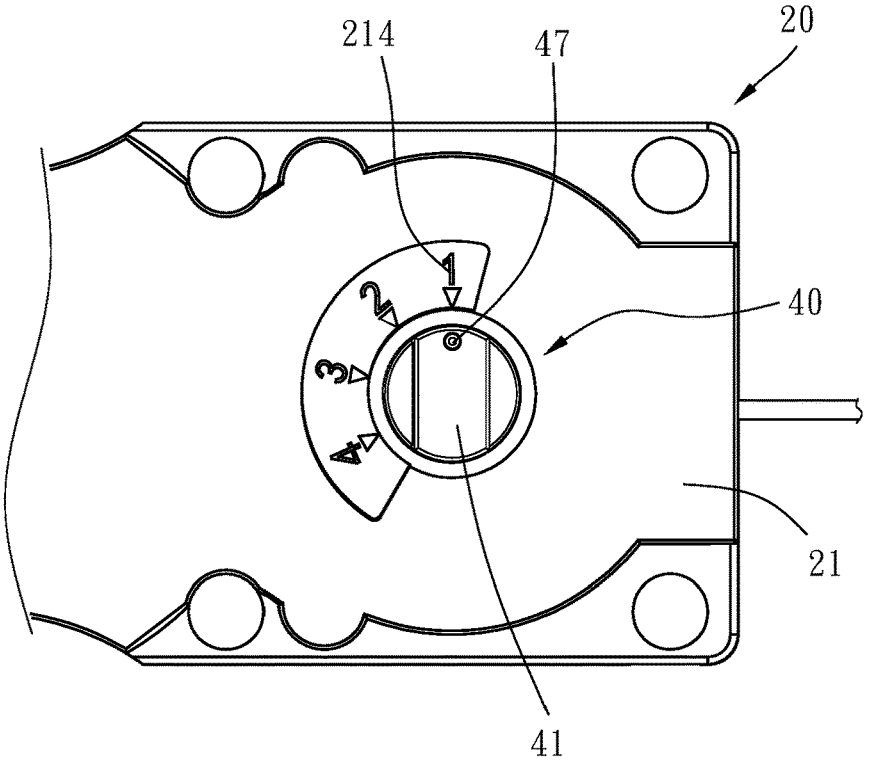
FIGS. 5*a*-5*d* are top views of the multistate resistance adjusting device of the present invention, primarily showing an indicating symbol of an operating portion of the control pin is located correspondingly to one of state marks of a top plate of a base.
Figure 5B:
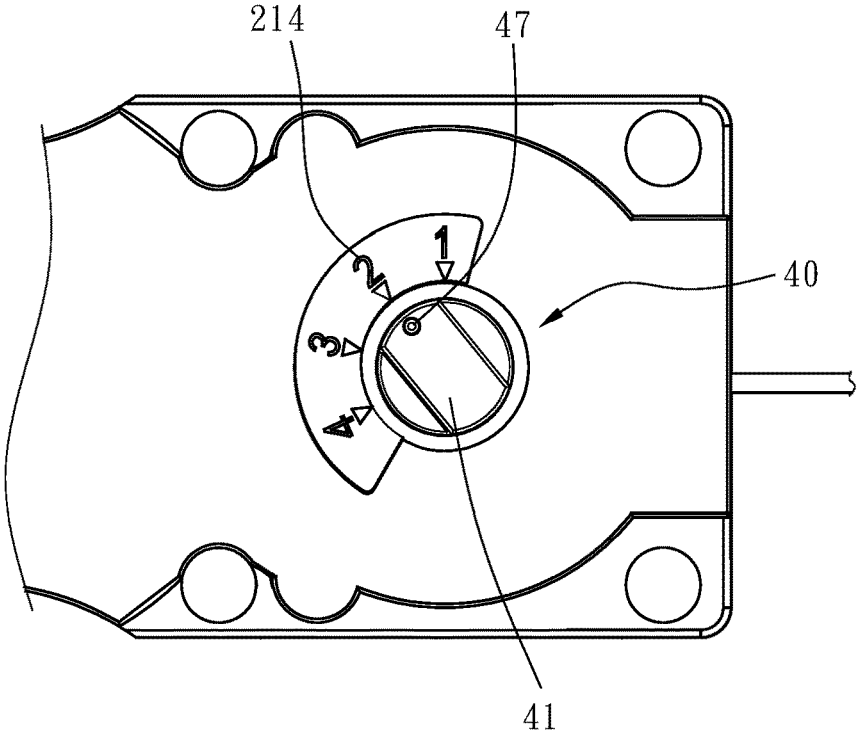
Figure 5C:
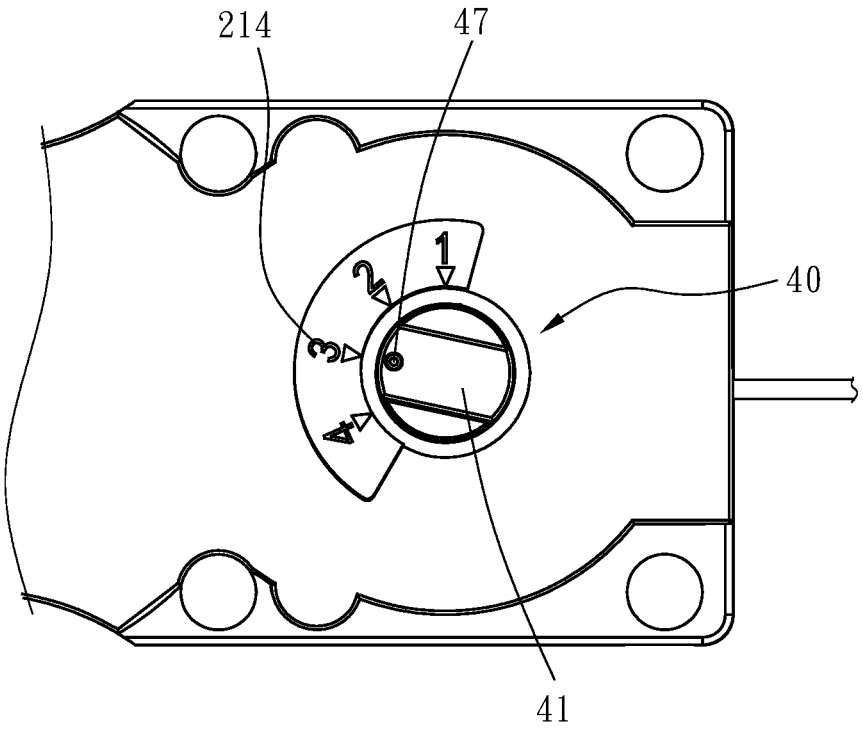
Figure 5D:
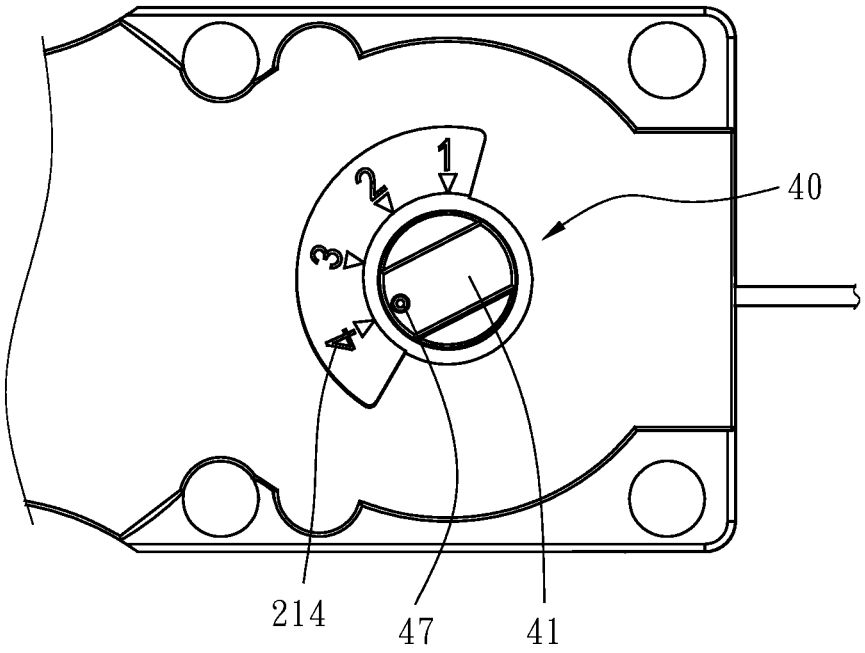

The adjusting unit 30 has a control pin 40. The control pin 40 has an operating portion 41, a transmission portion 42, a positioning portion 45, and a supporting portion 46. The operating portion 41 is inserted through the top hole 212 of the base 20 to protrude from the top plate 21 of the base 20, for being pulled by the user. The transmission portion 42 is integrally connected to the bottom end of the operating portion 41. The transmission portion 42 is provided at the bottom end thereof with a sleeve hole 43 which is circular-shaped in cross-section thereof, as shown in FIG. 3. By means of the sleeve hole 43 of the transmission portion 42, the control pin 40 is sleeved onto the fixed shaft 236 of the base 20 in a way that the control pin 40 is not only rotatable on its own axis relative to the base 20 but also displaceable vertically relative to the base 20 by means of the space in the top and bottom troughs 216 and 232, as shown in FIGS. 3-4. The positioning portion 45 is integrally connected to the outer peripheral surface of the bottom end of the transmission portion 42. The supporting portion 46 is integrally connected to the outer peripheral surface of the top end of the transmission portion 42 and located just above the positioning portion 45. Besides, the adjusting unit 30 has an adjusting rod 48 for being abutted against the lift transmission cord 14. As shown in FIGS. 2-4, the axis of the adjusting rod 48 is parallel to the axis of the fixed shaft 236 of the base 20. Besides, the top and bottom ends of the adjusting rod 48 are connected with the supporting portion 46 of the control pin 40 and the positioning portion 45 of the control pin 40 respectively, so that the adjusting rod 48 is movable synchronously with the control pin 40.

It can be understood from the above illustration that when the control pin 40 is located at a positioning position P1 as shown in FIG. 3, the supporting portion 46 of the control pin 40 is located below the top trough 216 of the top plate 21 of the base 20, and the positioning portion 45 of the control pin 40 is located in the bottom trough 232 of the bottom plate 23 of the base 20 and engaged with one of the positioning grooves 238 of the bottom plate 23 of the base 20, so that the control pin 40 is disabled from rotating relative to the base 20. In opposite, when the control pin 40 is located at an adjusting position P2 as shown in FIG. 4, the supporting portion 46 of the control pin 40 is located in the top trough 216 of the top plate 21 of the base 20, and the positioning portion 45 of the control pin 40 is located above the bottom trough 232 of the bottom plate 23 of the base 20, so that the positioning portion 45 of the control pin 40 is separated from the positioning groove 238 which the positioning portion 45 is engaged with previously; at this time, the control pin 40 can drive the adjusting rod 48 to rotate together relative to the base 20.

Referring to FIGS. 3-4, the elastic member 50 is disposed between the top plate 21 of the base 20 and the transmission portion 42 of the control pin 40 for providing elastic force to keep the control pin 40 located at the positioning position P1 as shown in FIG. 3. Specifically speaking, the transmission portion 42 of the control pin 40 has an accommodating groove 44 for accommodating the elastic member 50. The elastic member 50 is sleeved onto the transmission portion 42 of the control pin 40. The top end of the elastic member 50 is located out of the accommodating groove 44 and abutted on the bottom surface of the top plate 21 of the base 20. The bottom end of the elastic member 50 is located in the accommodating groove 44 and abutted on the bottom wall of the accommodating groove 44.

For the adjustment of the resistance applied on the lift transmission cord 14, the operating portion 41 of the control pin 40 is firstly used to let the control pin 40 be pulled up from the positioning position P1 as shown in FIG. 3 to the adjusting position P2 as shown in FIG. 4, so that the positioning portion 45 of the control pin 40 is separated from the positioning groove 238 of the bottom plate 23 of the base 20. At this time, the elastic member 50 is compressed by the inner wall of the accommodating groove 44 to save the resilient force. After that, the control pin 40 can be rotated. During the rotation of the control pin 40, the cord arrangement of the lift transmission cord 14 is changed through the adjusting rod 48, as shown in FIGS. 6*a*-6*d*, so that the effect of resistance adjustment is attained. During the aforesaid resistance adjustment, as shown in FIGS. 5*a*-5*d*, the user can control the magnitude of the resistance by means of an indicating symbol 47 provided on the operating portion 41 of the control pin 40 and the state marks 214 of the top plate 21 of the base 20. The larger number the state mark 214 shows, the larger angle the control pin 40 drives the adjusting rod 48 to rotate and the larger resistance the lift transmission cord 14 is applied with.

When the adjustment is finished, as long as the pull force applied on the control pin 40 is relieved, the control pin 40 will be moved back to the positioning position P1 as shown in FIG. 3 by the resilient force of the elastic member 50, so that the positioning portion 45 of the control pin 40 is located in the bottom trough 232 of the bottom plate 23 of the base 20 and engaged with one of the positioning grooves 238 as shown in FIGS. 6*a*-6*d*. At this time, the control pin 40 is unable to be rotated, so the adjusting rod 48 is also unable to rotate together. The indicating symbol 47 of the operating portion 41 of the control pin 40 is located correspondingly to one of the state marks 214 at this time as shown in FIGS. 5*a*-5*d*, enabling the user to know the magnitude of the resistance after the adjustment.

In conclusion, the multistate resistance adjusting device 10 of the present invention can adjust the resistance applied on the lift transmission cord 14 as long as the control pin 40 is moved upwardly to the adjusting position P2. The whole adjusting process needs no structural disassembly and assembly, and the magnitude of the resistance can be accurately controlled by means of the cooperation of the indicating symbol 47 and the state marks 214, so that the usage convenience is increased and the assembly accuracy can be maintained.

What is claimed is:

1. A multistate resistance adjusting device for a non-pull cord window blind, the multistate resistance adjusting device comprising:

a base having a bottom plate and a top plate located on the bottom plate and connected with the bottom plate, the top plate having a top hole penetrating through a top surface and a bottom surface of the top plate, the bottom plate being provided on a top surface thereof with a bottom trough and a fixed shaft located correspondingly to the top hole of the top plate, a top end of the fixed shaft being located out of the bottom trough, a bottom end of the fixed shaft being located in the bottom trough, the bottom plate having a plurality of positioning grooves provided on a peripheral wall of the bottom trough and arranged at intervals in an arched manner about the fixed shaft;

an adjusting unit having a control pin and an adjusting rod, the control pin having an operating portion, a transmission portion and a positioning portion, the operating portion being inserted through the top hole of the top plate of the base to protrude from the top plate of the base, the transmission portion being connected with a bottom end of the operating portion, the positioning portion being provided on an outer peripheral surface of the transmission portion, the transmission portion of the control pin being sleeved onto the fixed shaft of the bottom plate of the base in a way that the control pin is rotatable and displaceable vertically between a positioning position and an adjusting position, the positioning portion of the control pin being located in the bottom trough of the bottom plate of the base and engaged with one of the positioning grooves of the bottom plate of the base to disable the control pin from rotating relative to the base when the control pin is located at the positioning position, the positioning portion of the control pin being located above the bottom trough of the bottom plate of the base and separated from the positioning grooves of the bottom plate of the base to enable the control pin to rotate relative to the base when the control pin is located at the adjusting position, an axis of the adjusting rod being parallel to an axis of the fixed shaft of the base, the adjusting rod being disposed on the positioning portion of the control pin so as to be movable synchronously with the control pin; and an elastic member disposed between the top plate of the base and the transmission portion of the control pin for keeping the control pin located at the positioning position.

2. The multistate resistance adjusting device as claimed in claim 1, wherein the top surface of the top plate of the base is provided with a plurality of state marks located around the top hole; the operating portion of the control pin has an indicating symbol; when the control pin is located at the positioning position, the indicating symbol is located correspondingly to one of the state marks.

3. The multistate resistance adjusting device as claimed in claim 1, wherein the transmission portion of the control pin has an accommodating groove for accommodating the elastic member; the elastic member is sleeved onto the transmission portion of the control pin; a top end of the elastic member is located out of the accommodating groove and abutted on the bottom surface of the top plate of the base; a bottom end of the elastic member is located in the accommodating groove and abutted on a bottom wall of the accommodating groove.

4. The multistate resistance adjusting device as claimed in claim 1, wherein the top plate of the base is provided on the bottom surface thereof with a top trough communicating with the top hole; the control pin further has a supporting portion provided on the outer peripheral surface of the transmission portion of the control pin; a top end and a bottom end of the adjusting rod are connected with the supporting portion of the control pin and the positioning portion of the control pin respectively; when the control pin is located at the positioning position, the supporting portion of the control pin is located below the top trough of the top plate of the base; when the control pin is located at the adjusting position, the supporting portion of the control pin is located in the top trough of the top plate of the base.

* * * * *